US005160965A

United States Patent [19]

Koide

[11] Patent Number: 5,160,965

[45] Date of Patent: Nov. 3, 1992

[54] IMAGE FORMING APPARATUS WITH SMALL LED ARRAY

[75] Inventor: Jun Koide, Tokyo, Japan

[73] Assignee: Canon Kabushiki Kaisha, Tokyo, Japan

[21] Appl. No.: 807,744

[22] Filed: Dec. 17, 1991

Related U.S. Application Data

[63] Continuation of Ser. No. 471,474, Jan. 29, 1990, abandoned.

[30] Foreign Application Priority Data

Jan. 30, 1989 [JP] Japan ..... 1-22291

[51] Int. Cl.[5] ..... G03G 15/04

[52] U.S. Cl. ..... 355/202; 355/218; 346/107 R

[58] Field of Search ..... 355/202, 218, 219, 228-229; 346/107 R, 160

[56] References Cited

U.S. PATENT DOCUMENTS

| | | | |
|---|---|---|---|
| 4,008,954 | 2/1977 | Ogawa et al. . | |
| 4,585,330 | 4/1986 | Yamamoto et al. | 355/218 |
| 4,640,601 | 2/1987 | Deguchi et al. | 355/218 |
| 4,734,734 | 3/1988 | Yano | 355/218 |
| 4,737,748 | 4/1988 | Ito . | |
| 4,864,364 | 9/1989 | Ogino et al. | 355/202 |
| 4,900,130 | 2/1990 | Haas | 346/107 R |
| 4,947,195 | 8/1990 | Flynn et al. | 346/160 X |

FOREIGN PATENT DOCUMENTS

| | | | |
|---|---|---|---|
| 039403 | 11/1981 | European Pat. Off. . | |
| 197719 | 10/1986 | European Pat. Off. . | |
| 348003 | 12/1989 | European Pat. Off. . | |
| 57-4071 | 1/1982 | Japan | 355/202 |
| 58-117569 | 7/1983 | Japan . | |
| 59-176763 | 10/1984 | Japan . | |
| 59-195256 | 11/1984 | Japan . | |
| 60-247663 | 12/1985 | Japan . | |
| 61-67875 | 4/1986 | Japan . | |
| 61-162065 | 7/1986 | Japan . | |
| 61-177474 | 8/1986 | Japan . | |
| 61-177475 | 8/1986 | Japan . | |
| 61-177476 | 8/1986 | Japan . | |
| 61-285478 | 12/1986 | Japan . | |
| 62-40476 | 2/1987 | Japan . | |
| 01031659 | 2/1989 | Japan . | |

*Primary Examiner*—Joan H. Pendegrass
*Attorney, Agent, or Firm*—Fitzpatrick, Cella, Harper & Scinto

[57] ABSTRACT

An image forming apparatus includes an image carrier, an LED (light emitting diode) array having a plurality of light-emitting units arranged in correspondence with the longer direction of the image carrier, the width of the LED array being smaller than an image carrying width of the image carrier, and a projection unit for projecting and magnifying the light from the LED array upon the image carrier.

46 Claims, 15 Drawing Sheets

IMAGE FORMING APPARATUS WITH SMALL LED ARRAY

This application is a continuation of application Ser. No. 07/471,474 filed Jan. 29, 1990, now abandoned.

BACKGROUND OF THE INVENTION

1. Field of the Invention

This invention relates to an image forming apparatus using an electrophotographic process, and more particularly, to an image forming apparatus for exposing an image carrying member by an LED (light emitting diode) array.

2. Description of the Related Art

Apparatuses for removing unnecessary electric charges on an image carrying member using LED's in conventional copiers are disclosed in U.S. Pat. No. 4,585,330, Japanese Patent Public Disclosure (Kokai) Nos. 58-117569 (1983), 61-67875 (1986), 61-177474 (1986), 61-177475 (1986), 61-177476 (1986), 62-40476 (1987), and the like. In all of these disclosures, LED's are arranged in a direction perpendicular to the direction of magnification variation of an image carrying member, and the images of the LED's are projected upon the image carrying member with unit magnification by a normal lens array, a lens array having a refractive index distribution, or a reflective optical system.

In any method, however, since LED's are disposed in close contact with the image carrying member and the images of the LED's are projected with unit magnification, there are the following three disadvantages. First, since the images are projected with unit magnification, a very long array of LED's is required. A complicated optical member, such as a lens array or the like, is therefore required and the entire apparatus becomes large. Second, since such a long array of LED's is required, several LED chips must be arranged individually divided to form the array. Accuracy in arrangement pitch is therefore inferior and it is very difficult to provide a uniform distribution of the amount of light of projected images in the direction of arrangement, which has a ripple (variations). Third, since the LED's are arranged in close contact with the image carrying member, a space is required in addition to electrophotographic process regions (e.g. an exposure region, a developing region, a transfer region, a cleaning region and a charging region) around the image carrying member. The image carrying member must therefore be large and, as a result, the apparatus becomes large. The conventional methods have the inconveniences as described above.

SUMMARY OF THE INVENTION

It is an object of the present invention to provide an apparatus in which an LED array is made small by performing magnified projection of the light from LED's.

It is another object of the present invention to provide an apparatus which superposes the light beams from respective LED's of an LED array on an image carrying member.

It is still another object of the present invention to provide an apparatus which exposes an image carrying member by an LED array having a high accuracy in the arrangement of LED's.

In one aspect of the invention, an image forming apparatus is provided that includes an image carrier, an LED (light emitting diode) array having a plurality of light-emitting units arranged in correspondence with the longer direction of the image carrier, the width of the LED array being smaller than an image carrying width of the image carrier, and a projection unit for magnifying and projecting light from the LED array onto the image carrier.

These and other objects of the present invention will become more apparent from the following description.

BRIEF DESCRIPTION OF THE DRAWINGS

FIG. 3-1 is a diagram of the arrangement of LED chips of an LED array used in the FIG. 2 embodiment, with FIG. 3-2 an enlarged view of light emitting units;

FIG. 6(*b*) is a diagram for explaining variation in aberration in the apparatus shown in FIG. 6(*a*);

DESCRIPTION OF THE PREFERRED EMBODIMENTS

The preferred embodiments of the present invention will now be explained with reference to the drawings.

Figure 1:
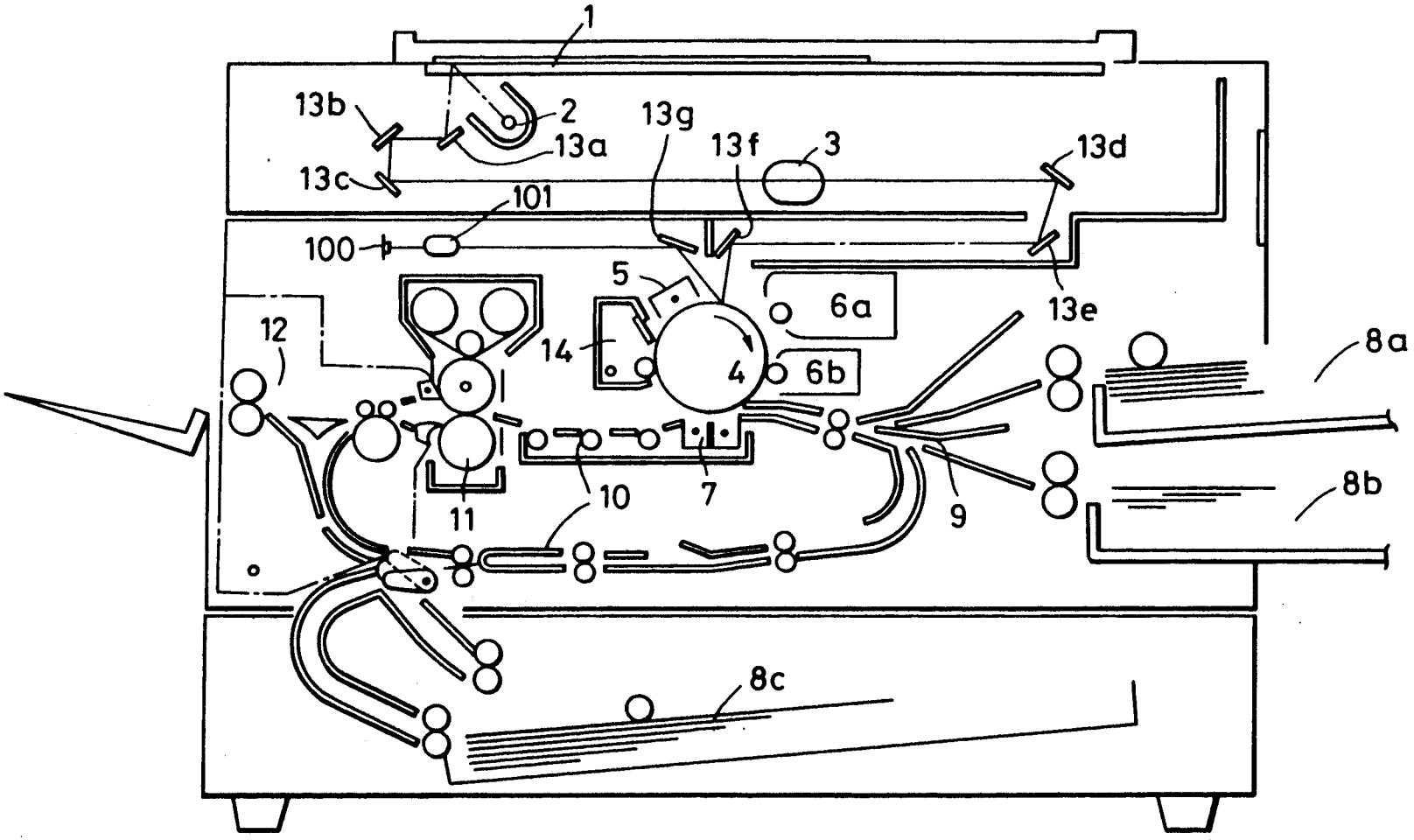
FIG. 1 is a cross-sectional view of a copier to which an image forming apparatus according to the present invention is applied.

FIG. 1 is a schematic diagram of a copier to which an image forming apparatus according to the present invention is applied. In FIG. 1, an original disposed on an original holder 1 is illuminated by an illuminating unit 2. Image information made of the diffused light reflected from the original and an emission pattern of an LED array 100 is formed on an image carrying member 4 as a latent image by first exposure means for exposing the image carrying member 4 with the diffused light via mirrors 13*a*–13*f* and a projection imaging lens 3 and second exposure means for exposing the image carrying member 4 with the emission pattern via a projection imaging lens 101 and a mirror 13*g*. The latent image is developed with toners by developers 6*a* and 6*b*. The toner image is transferred by a transfer unit 7 from the image carrying member 4 to a transfer material conveyed from trays 8*a*, 8*b* or 8*c* by a paper-feeding system 9. The transfer material enters a fixing unit 11 via a conveying system 10, is fixed in the fixing unit 11, and is output by a paper-discharging system 12. After the transfer of the toner image, the residual toner on the image carrying member 4 is cleaned by a cleaner 8. The image carrying member 4 is then charged by a charger 5, and enters again exposure process.

Figure 2:
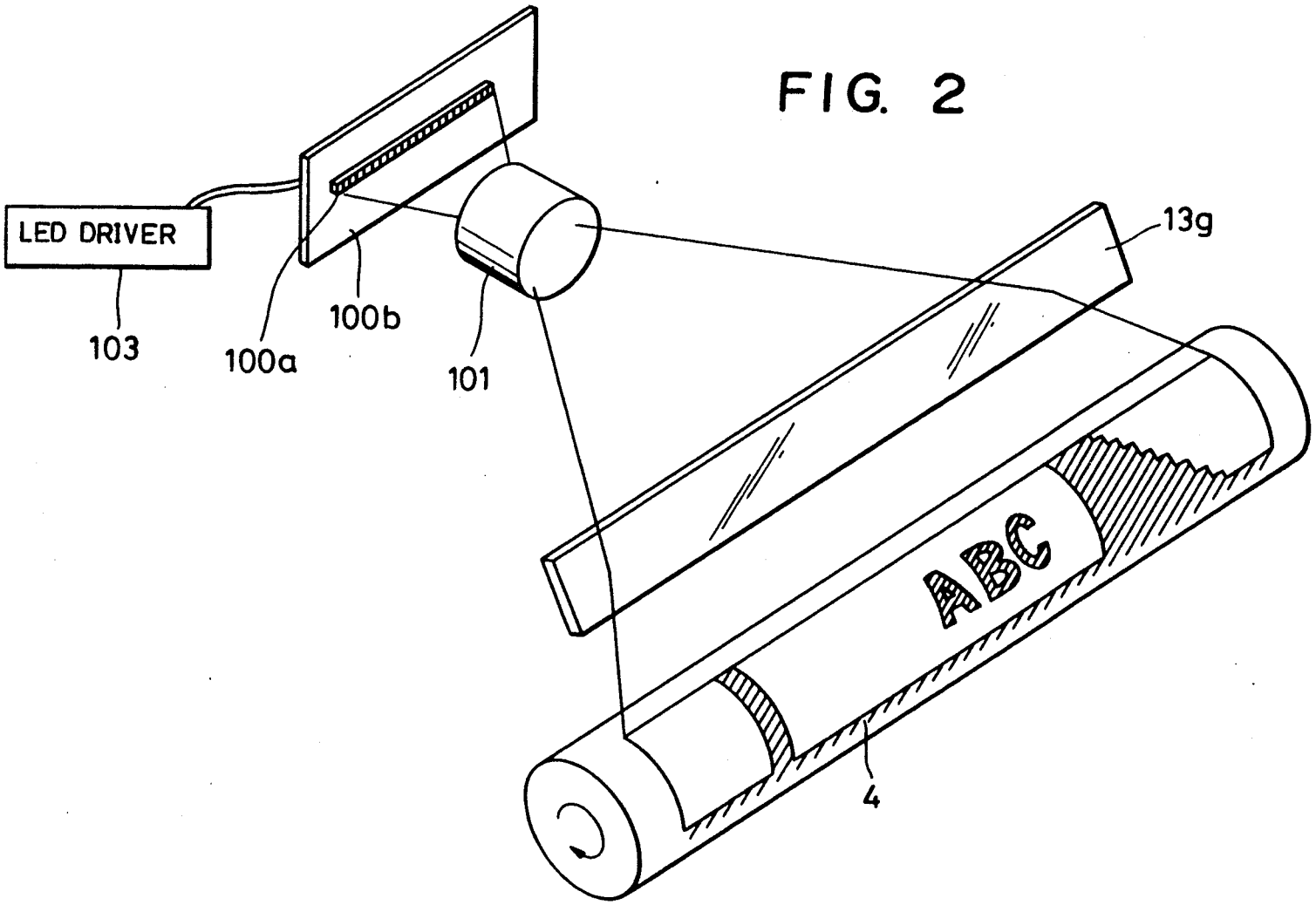
FIG. 2 is a diagram showing an image forming apparatus according to an embodiment of the present invention.

FIG. 2 shows an image forming apparatus according to an embodiment of the present invention, and shows the second exposure means described above.

As shown in FIG. 2, the second exposure means forms an emission pattern of an LED array by an LED driver 103, and performs magnified projection of the light beam of the pattern emitted from an rectangular high-density array 100*a* of LED's onto the exposure region of the first exposure means on the image carrying member 4 by the projection imaging lens 101.

The LED driver 103 controls the emission of each LED of the LED array, and can perform a high-definition exposure in accordance with the image information.

The LED array is disposed facing the image carrying member 4. The width of the LED array is smaller than an image-carrying width of the image carrying member 4 within which an image can be formed in the longer direction of the image carrying member 4.

The light when all the LED's of the LED array are lit is subjected to magnified projection so as to irradiate at least the entire width of a region of the image carrying member 4 within which an image can be formed.

Thus, in the present embodiment, by performing magnified projection of the emission pattern of the LED array from a location far from the image carrying member by the projection imaging lens, and exposing the region or near the region on the image carrying member where the image of the copy is to be projected, it becomes unnecessary to provide a space in addition to the electrophotographic process regions around the image carrying member and to make the image carrying member large. It is thereby possible to provide a small image forming apparatus.

Furthermore, since the LED array is subjected to magnified projection, a small LED array may be used. Hence, it is possible to provide a low-cost apparatus compared with an apparatus which requires a certain amount of width in the longer direction of the image carrying member.

Figures 1, 3:
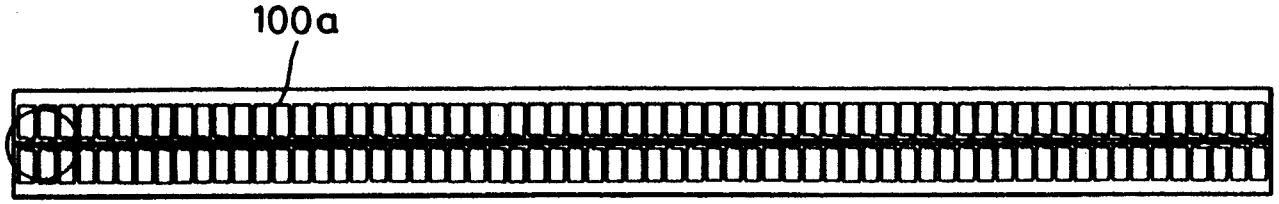
Figures 2, 3:
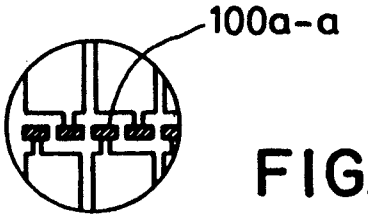

FIG. 3 shows a diagram of the arrangement of the light emitting positions of each LED unit of the LED array used in the FIG. 2 embodiment, with an enlarged view of the form of light-emitting units. The LED array is produced by a photolithographic process which forms a pattern by means of selective removal by light. In one example of the photolithographic process, a resist is coated on a wafer having a structure of three layers made of n-GaAlAs, p-GaAlAs and p-GaAs. The light from a mask projection optical system, such as a stepper or the like, is projected upon the coated resist, and portions on which the light has not been projected are then etched away by chemical dissolution to form high-density LED pixels (LED picture elements). Since the accuracy in the arrangement of the LED array depends on the accuracy of a projection mask, it is possible to form the LED pixels with a very high accuracy (an accuracy as high as about 0.2 μm is possible in the current lithography). The LED's thus arranged in high density on an identical substrate by a photolithographic process provide a monolithic LED array. Subsequently, probe connection, coating of an insulating material and connection with an electric substrate by wire bonding are performed for the LED array. In place of the above-described photolithography, laser lithography, X-ray lithography and the like may also be utilized.

As described above, the LED array used in the present embodiment is a monolithic LED array formed by a photolithographic process which provides a high-density arrangement. Since the accuracy in an arrangement pitch of the LED pixels is very high, it is possible to suppress a ripple in the amount of light of the LED array, and the distribution of the amount of light of a projected image can be uniform.

Next, optical aberrations due to the projection imaging lens for the LED array will be explained.

Figure 4:
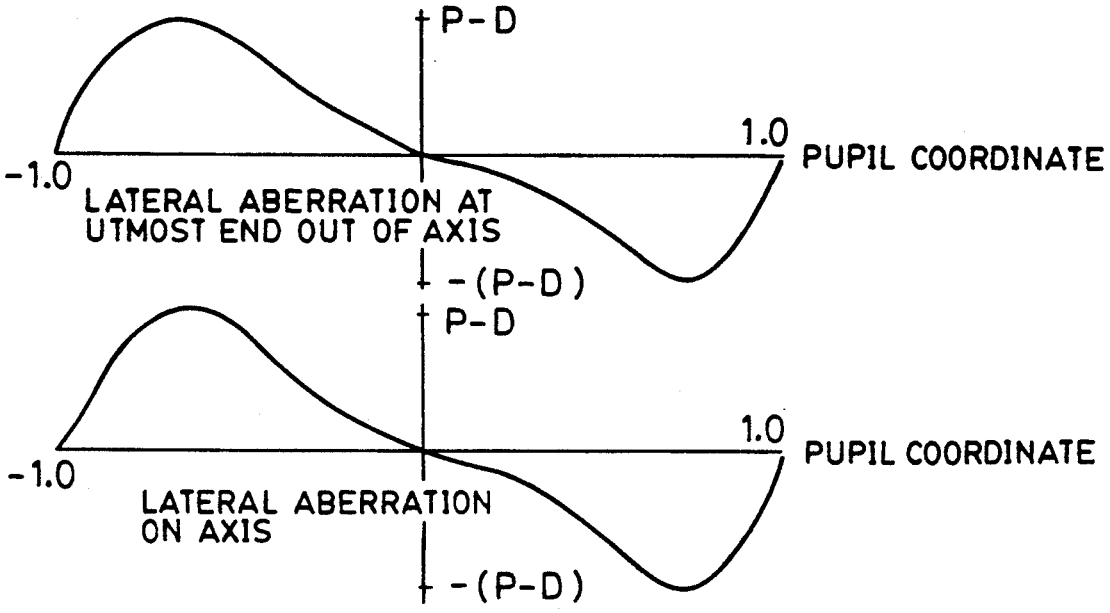
FIGS. 4(*a*)–4(*d*) are diagrams for explaining aberration, an example of image recording, projected pixels (picture elements) of LED's, and a distribution of the amount of projected light, respectively, when a projection imaging lens used in the FIG. 2 embodiment is of a softfocus type.
Figure 4:
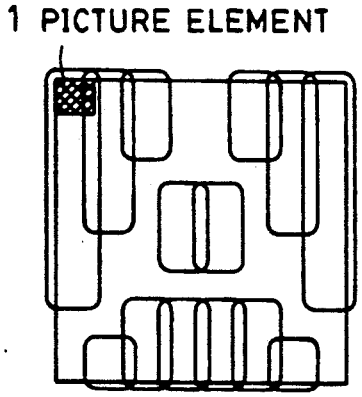
Figure 4:
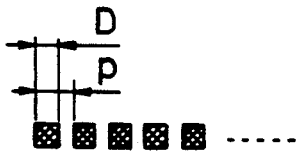
Figure 4:
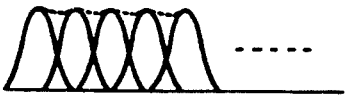

FIG. 4(*a*) shows the amounts of aberration formed on the image carrying member by the imaging lens used in the present embodiment. In FIG. 4(*a*), "lateral aberration at utmost end out of axis" represents the amount of aberration at an end portion of the image region in the longer direction of the image carrying member, and "lateral aberration on axis" represents the amount of aberration at a central portion of the image region.

That is, in the present embodiment, as the imaging lens for performing magnified projection of the light from the LED array upon the image carrying member, a soft-focus lens for performing soft-focus projection is adopted. The term "soft focus" represents a case in which light beams emitted from respective LED's of the LED array pass through a lens having aberration and are superposed on an imaging plane.

The maximum amount of lateral aberration of the imaging lens used in the present embodiment has an amount of aberration of (P-D) or more, where P is the pitch of the projected LED pixels shown in FIG. 4(*c*), and D is the width of the pixel in the direction of arrangement.

Although, in the present embodiment, the amounts of aberration at an end portion and a central portion of the image forming region are measured, as shown in FIG. 4(*a*), only the amount of aberration at the central portion may satisfactorily be used as a reference, because the amount of aberration at a central portion is generally smaller than that at an end portion.

Thus, in the present embodiment, positions in the image carrying member which correspond to positions between adjacent LED's where light is not emitted are also irradiated, and it is possible to make the distribution of the amount of the projected light uniform when all the LED's are lit, as shown in FIG. 4(*d*). Hence, pattern formation by a background exposure as shown in FIG. 4(*b*) becomes possible without producing vertical stripes.

Figure 5:
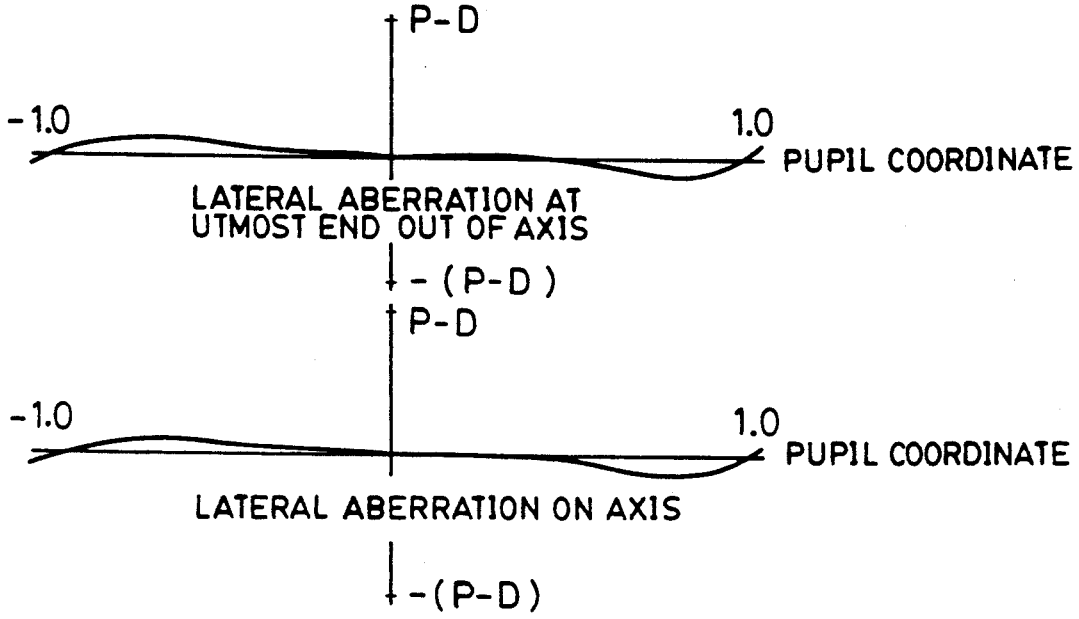
FIGS. 5(*a*)–5(*d*) are diagrams for explaining aberration, an example of image recording, projected pixels of LED's, and a distribution of the amount of projected light, respectively, for a projection imaging lens having aberration which is smaller than that of the projection imaging lens shown in FIG. 4.
Figure 5:
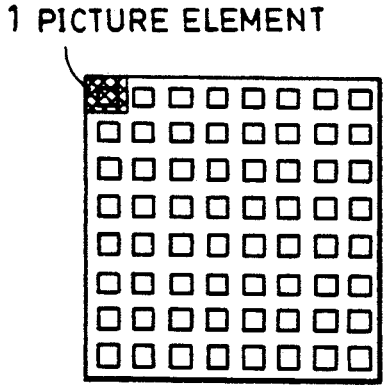
Figure 5:
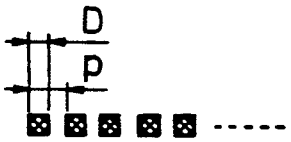
Figure 5:
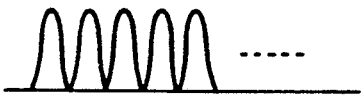

FIG. 5 is an explanatory diagram when a lens having the amount of lateral aberration which is smaller than that in the case of FIG. 4 is used.

That is, if a lens having a small amount of lateral aberration as shown in FIG. 5(*a*) is intentionally used, the distribution of the amount of the projected light as shown in FIG. 5(*d*) is provided, and an inverted mesh pattern as shown in FIG. 5(*b*) is formed. Thus, by superposing the pattern with an image formed on the image carrying member by the first exposure means, it becomes possible to form a pseudophotographic-mode image.

In this case, the maximum amount of lateral aberration is smaller than (P-D), which is obtained by subtracting the width D of the pixel in the direction of arrangement from the pitch P of the LED pixels shown in FIG. 5(*c*).

Figure 6:
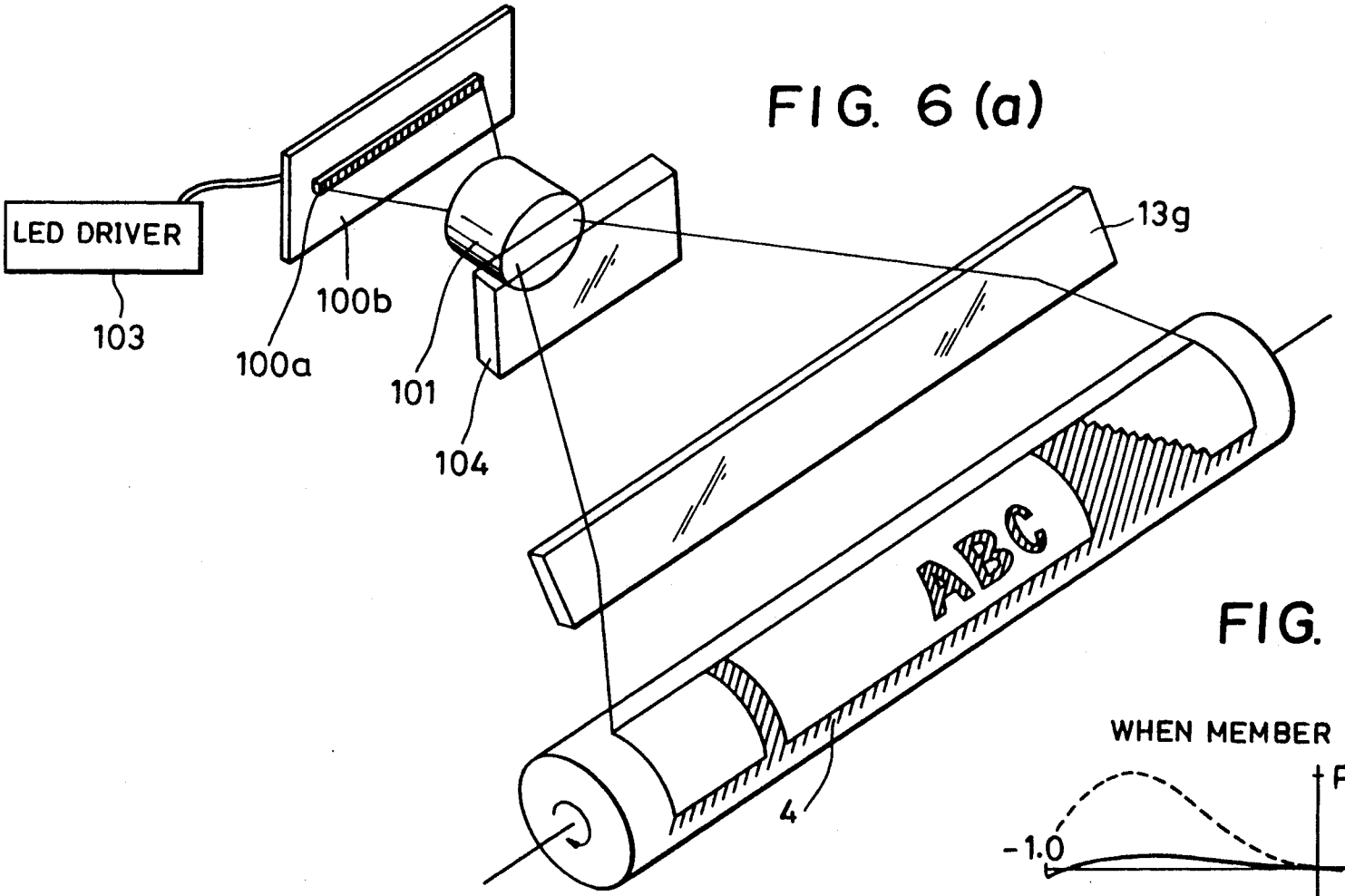
FIG. 6(*a*) shows an image forming apparatus according to another embodiment of the present invention in which a parallel-plane optical member is inserted in the apparatus shown in FIG. 2.
Figure 6:
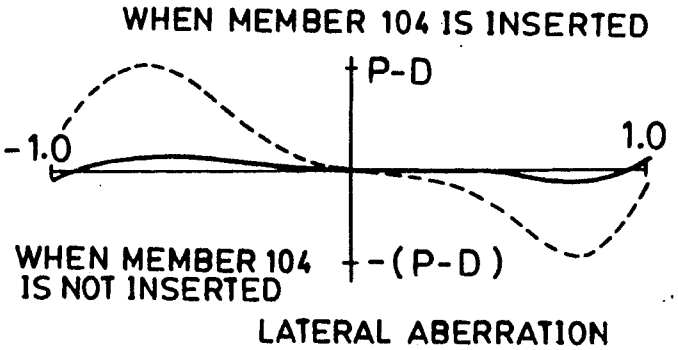

FIG. 6 consists of diagrams for explaining an image forming apparatus according to still another embodiment of the present invention.

FIG. 6(*a*) shows the image forming apparatus of the present embodiment, in which it becomes possible to switch between modes shown in FIGS. 4 and 5.

The switching is executed by performing conversion of lateral aberration shown in FIG. 6(*b*) by inserting and removing a parallel-plane optical member 104 having aberration, thus providing the ability to operate in two modes.

Next, still another embodiment of the present invention will be explained.

Since the configuration of the apparatus is identical to that in the embodiment explained with reference to FIG. 2, only portions which are different from those in FIG. 2 will be explained.

Figure 7:
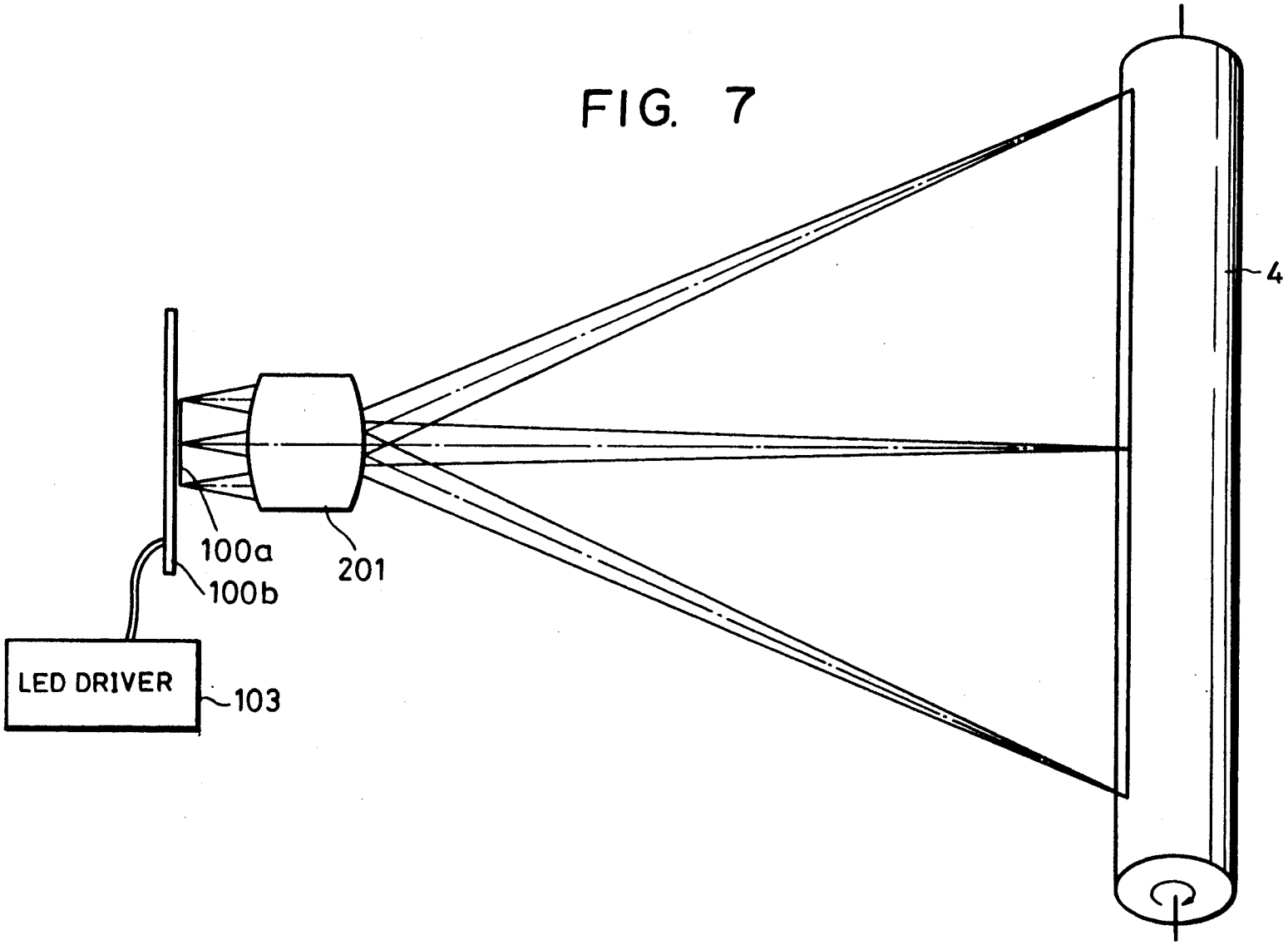
FIG. 7 shows an image forming apparatus according to still another embodiment of the present invention in which a projection imaging lens constitutes a telecentric optical system at the side of LED's.
Figure 8:
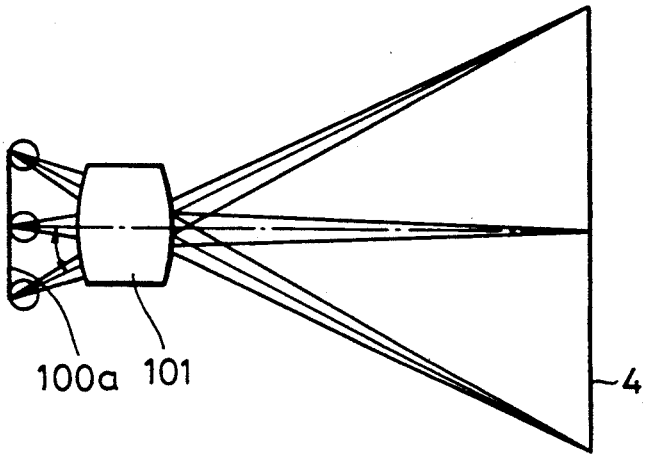
FIGS. 8(*a*) and 8(*b*) are a projection and a diagram, respectively, for explaining a distribution of the amount of light when a lens having angles of view at both the image side and object side is used.
Figure 8:
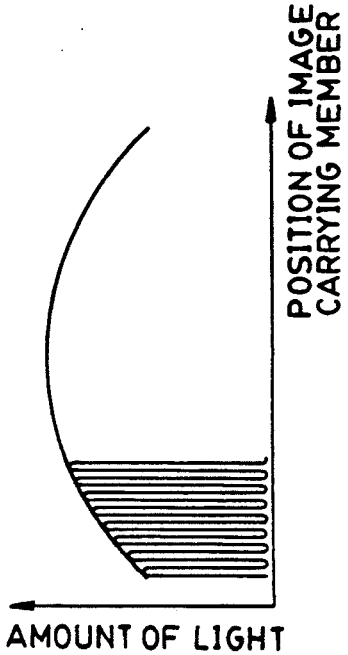
Figure 9:
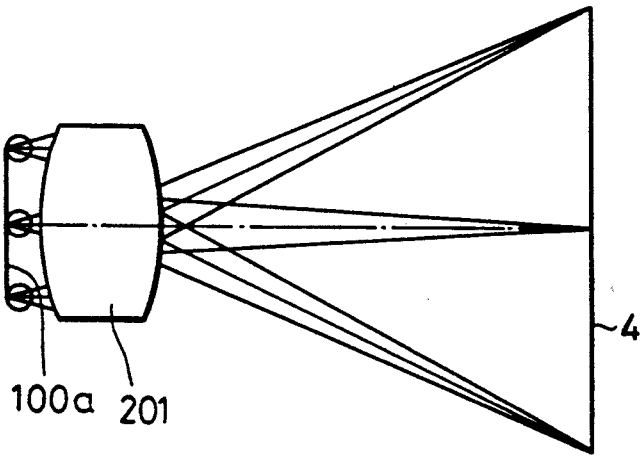
FIGS. 9(*a*) and 9(*b*) are a projection and a diagram, respectively, for explaining a distribution of the amount of light when a telecentric optical system is used.
Figure 9:
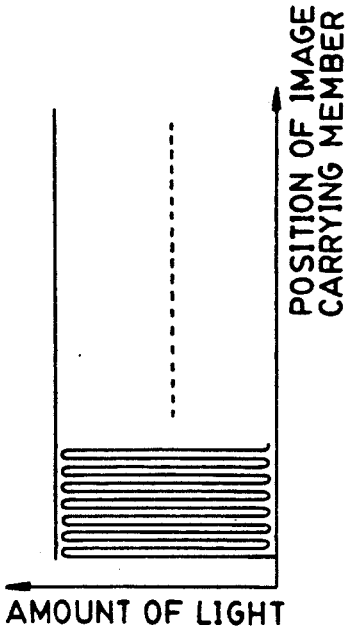

FIG. 7 shows an apparatus according to the present embodiment. In FIG. 7, a projection lens which comprises a telecentric optical system is used at the side of the LED array. That is, when the LED array is projected by a single lens, projection is performed by an imaging lens 101 having angles of view at both the image side and object side, as shown in FIG. 8(*a*). Hence, in regions having high angles of view, the amount of projected light is reduced by as much as $\cos^4\theta$ on the optical axis, and the distribution of the amount of projected light is not become uniform, as shown in FIG. 8(*b*). To the contrary, in the present embodiment, lens 201 is arranged so that it is telecentric with its entrance pupil seen from the side of the LED array existing at an infinite distance. Thus, $\cos^4\theta=1$ for this lens. That is, this lens have an angle of view at the side of the LED $\theta=0°$, as shown in FIG. 9(*a*). It thereby becomes possible to make the distribution of the amount of projected light of the LED array uniform, as shown in FIG. 9(*b*), and stable image formation without unevenness in exposure can be performed.

A method of adjusting the amount of aberration of the LED image formed on the imaging surface will now be explained.

Figure 10:
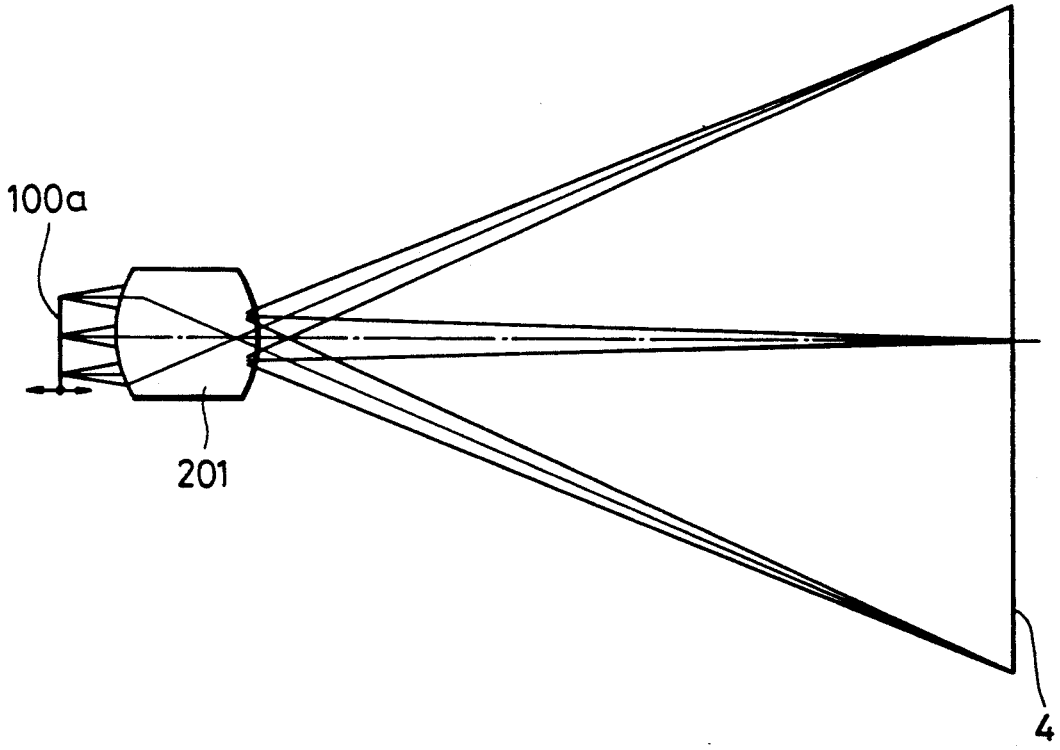
FIGS. 10(*a*)–10(*d*) are diagrams for explaining a method of adjusting the amount of aberration of a projection imaging lens.
Figure 10:
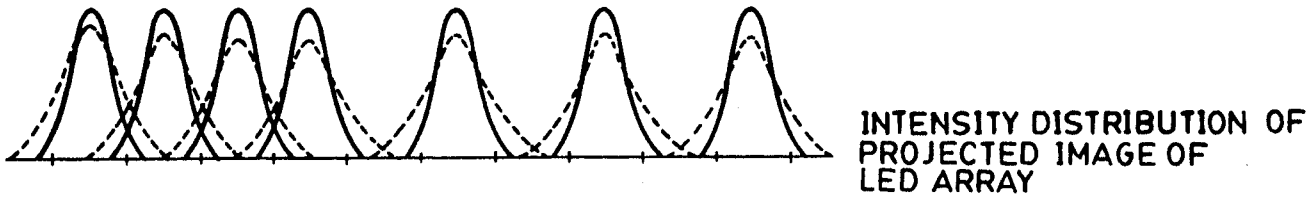
Figure 10:
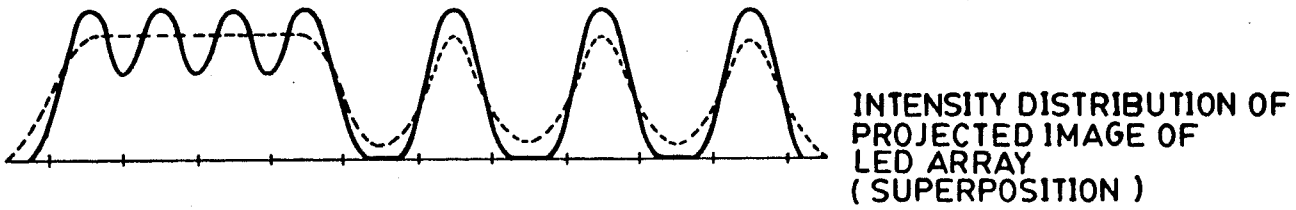
Figure 10:
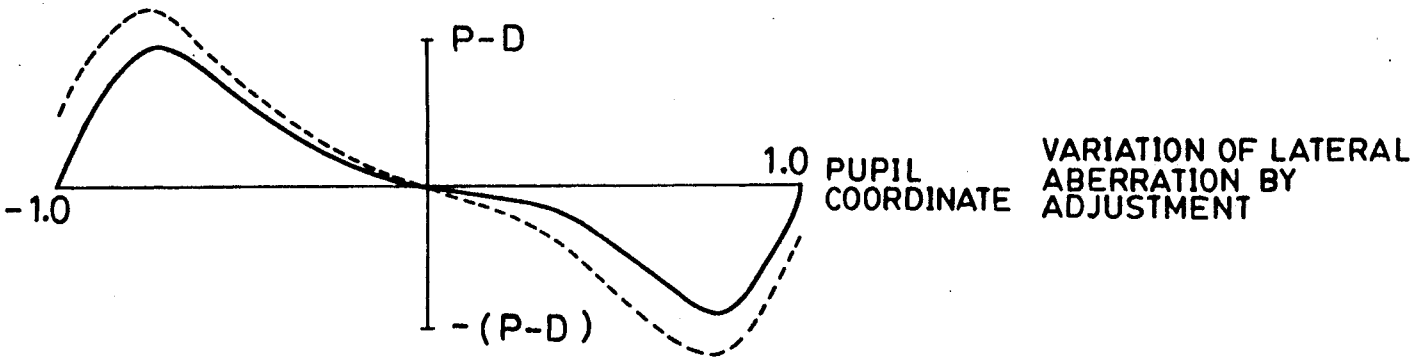

In the method of adjusting the amount of aberration of the LED image, the LED array 100*a* is moved in the direction shown by arrow A in FIG. 10(*a*), namely, in the direction of the optical axis of the projection lens 201. Adjustment of lateral aberration as shown in FIG. 10(*d*) is performed so that the amount of light becomes uniform when adjacent LED's in the LED array are lit, as shown in the leftmost portions of FIGS. 10(*b*) and 10(*c*). The rightmost portions of FIGS. 10(*b*) and 10(*c*) depict the projected light intensity distribution when alternate LED's in the LED array are lit.

Still another embodiment of the present invention will now be explained.

Since the configuration of the apparatus is identical to that of the embodiment explained with reference to FIG. 2, only portions which are different from those in FIG. 2 will be explained.

Figure 11:
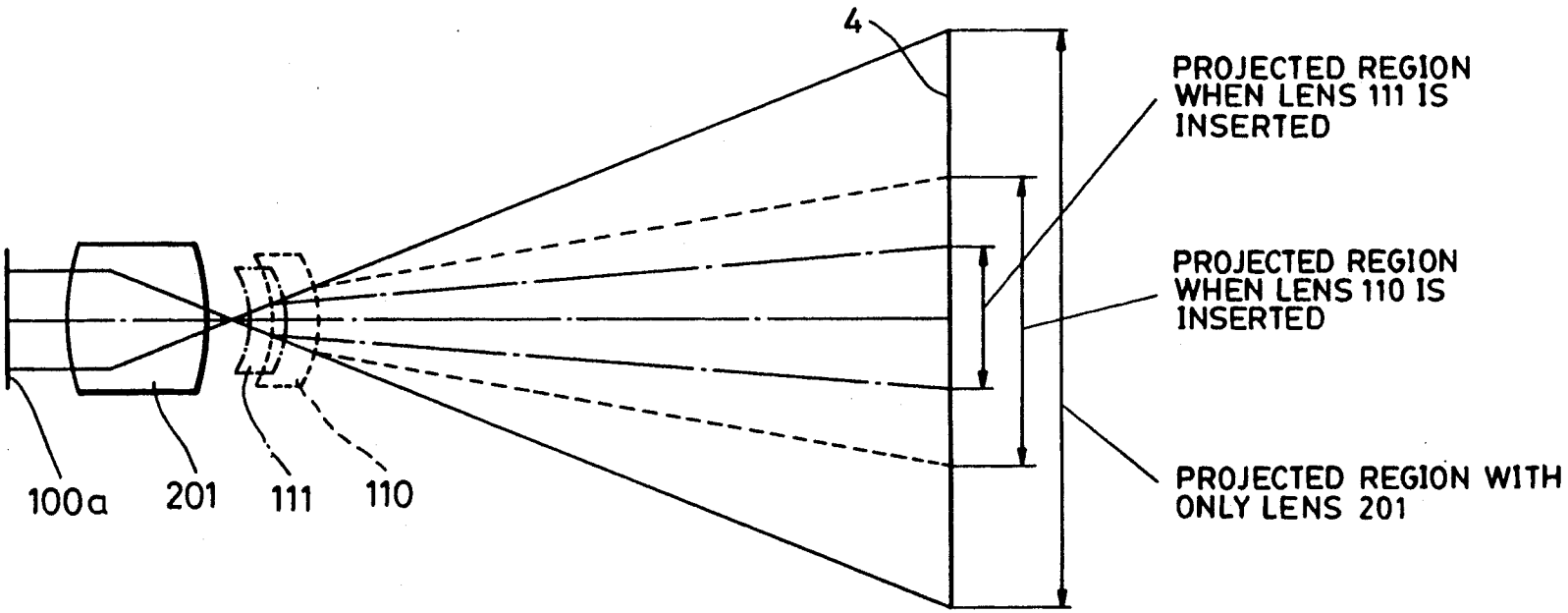
FIGS. 11 and 12 are diagrams for explaining projection by an attachment lens according to still another embodiment of the present invention.
Figure 12:
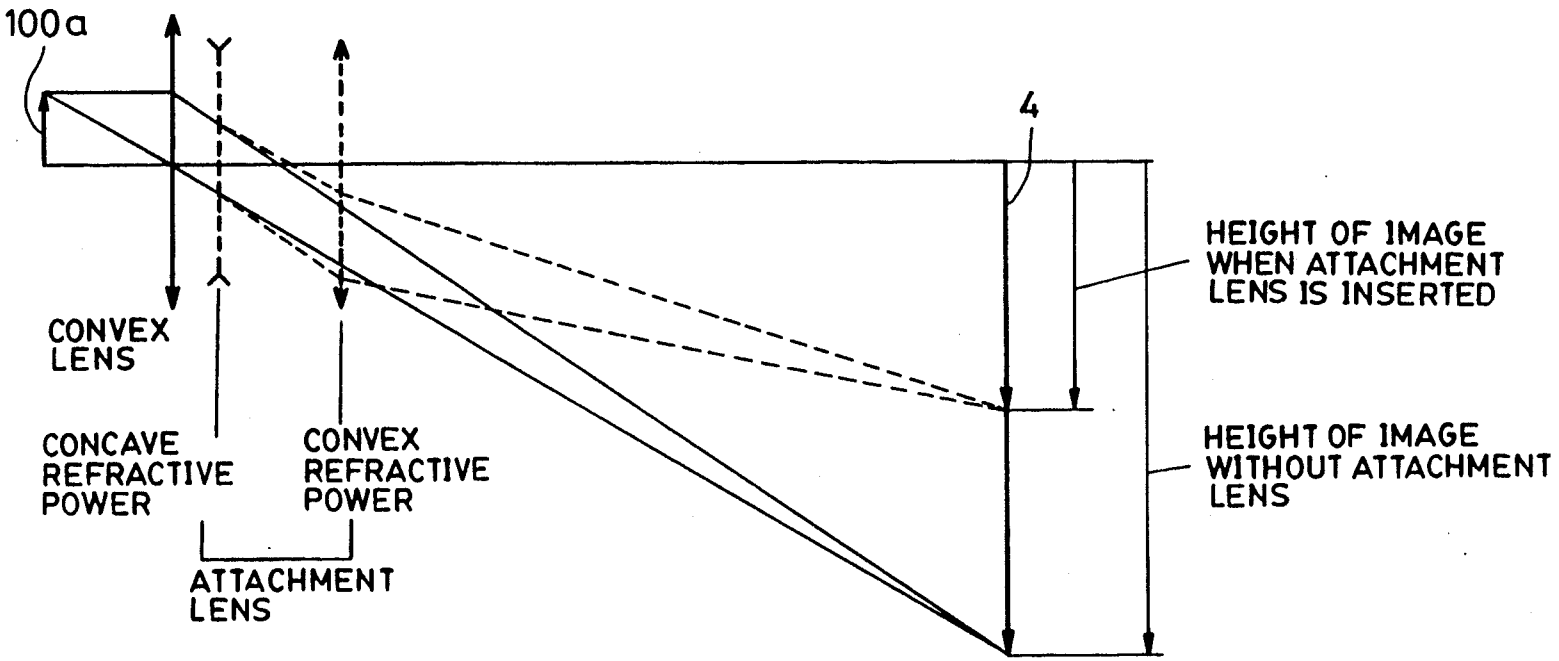

That is, in the present embodiment, as shown in FIGS. 11 and 12, by inserting an attachment lens 110 or 111 in addition to the projection imaging lens 201 of the LED array to convert the projection magnification of the LED array, the density of projected dots in exposure for removing unnecessary electric charges of a latent image on the image carrying member (hereinafter termed blank exposure) is converted (FIG. 12 is a diagram of light beams in the projection optical system).

That is, by performing the conversion of the density of projected dots, it becomes possible to perform a local high-definition blank exposure and an add-on function (a function of adding another image to the image of the copy) with a high definition.

Figure 13:
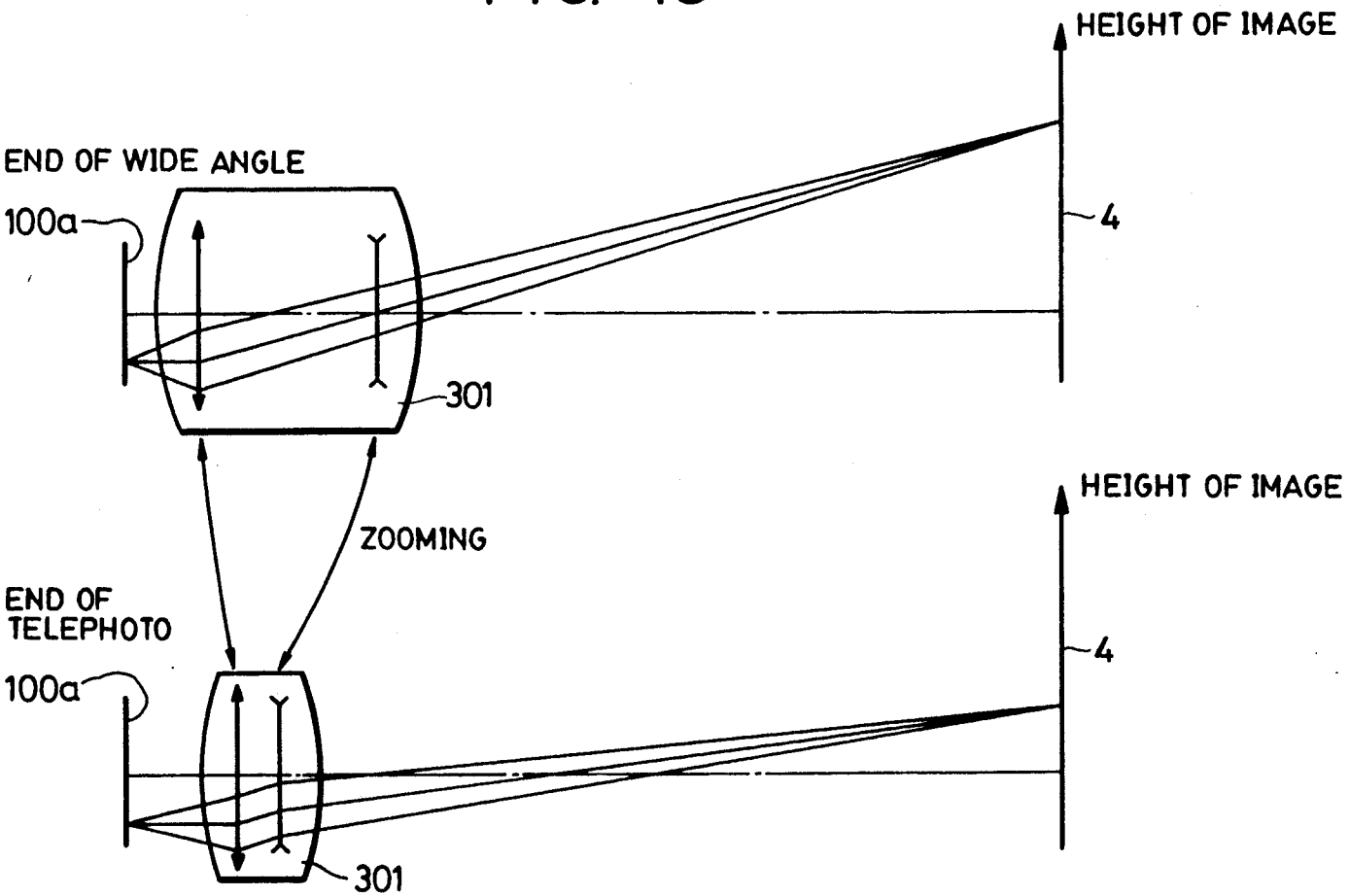
FIG. 13 is a diagram for explaining projection when a zoom lens is used in place of the lens means shown in FIG. 12.

Furthermore, as shown in FIG. 13, the same effect can also be obtained by converting the density of projected dots in blank exposure and the like using a zoom lens 301 having telecentric optics in place of the imaging lens 201 and the attachment lenses 110 and 111 shown in FIG. 11.

Figure 14:
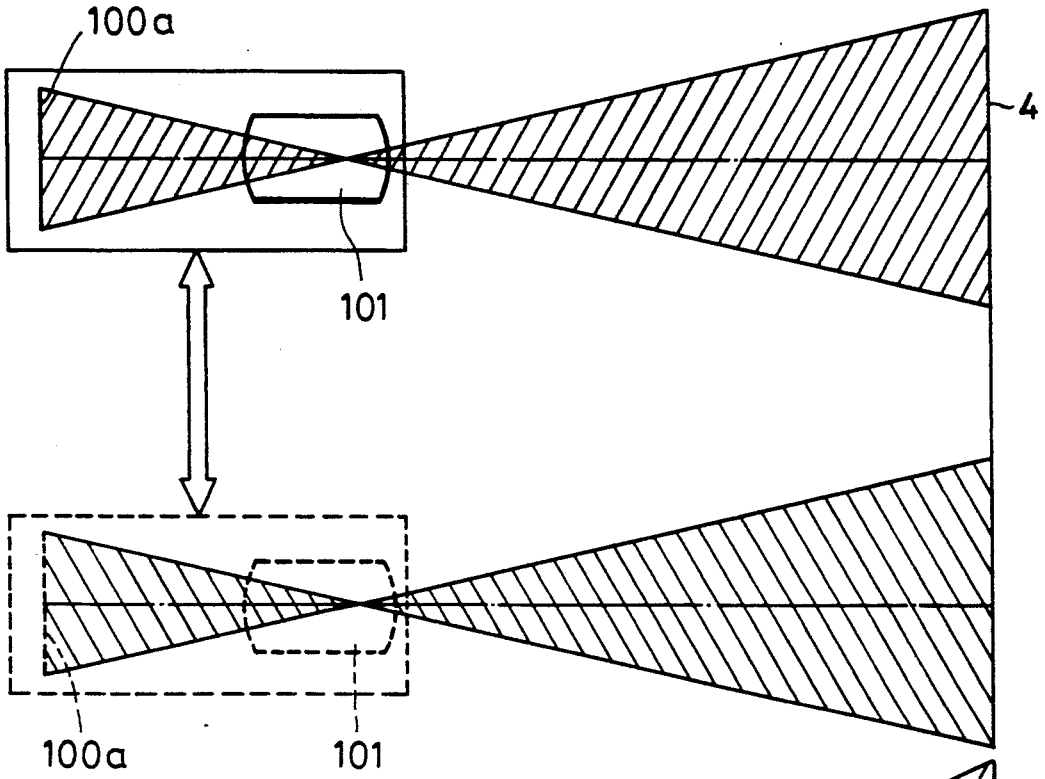
FIGS. 14(*a*) and 14(*b*) are diagrams for explaining the movement of an optical system in the image forming apparatus shown in FIG. 2.
Figure 14:
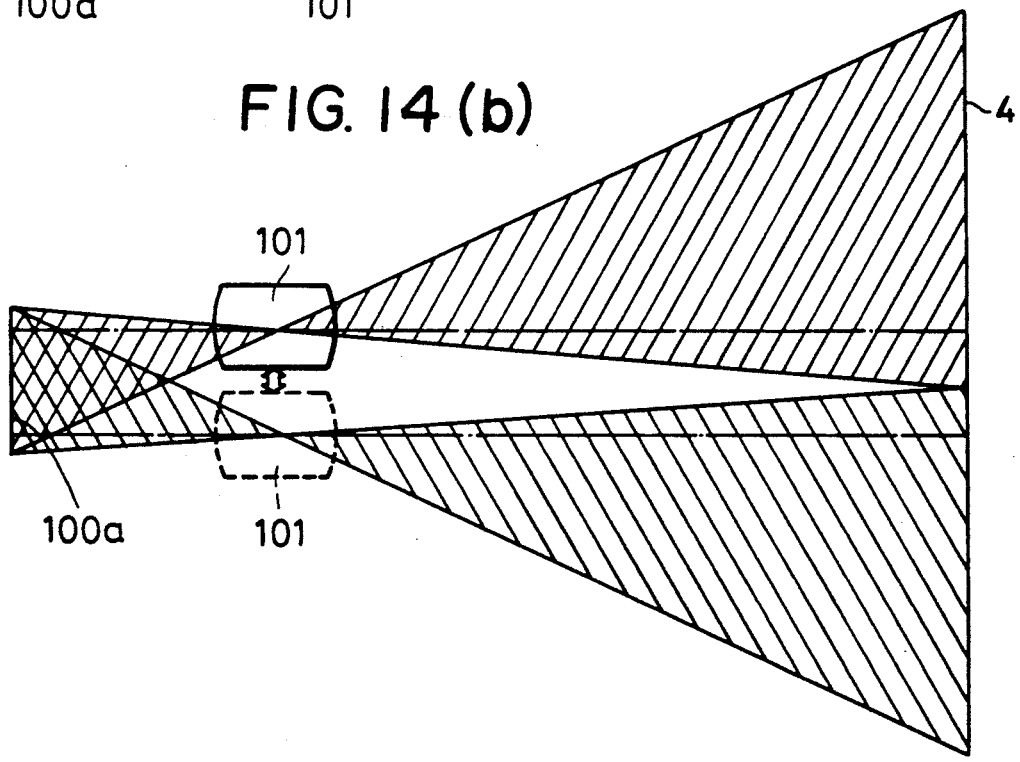

Moreover, by movably arranging the projection system of the LED array in the direction of the arrangement of the LED array, as shown in FIG. 14(*a*), and by movably arranging the projection lens 101 in the direction of the arrangement of the LED array, as shown in FIG. 14(*b*), it is possible to move the projection region of the image of the LED array to an arbitrary location to perform blank exposure or add-on with high definition.

Figure 15:
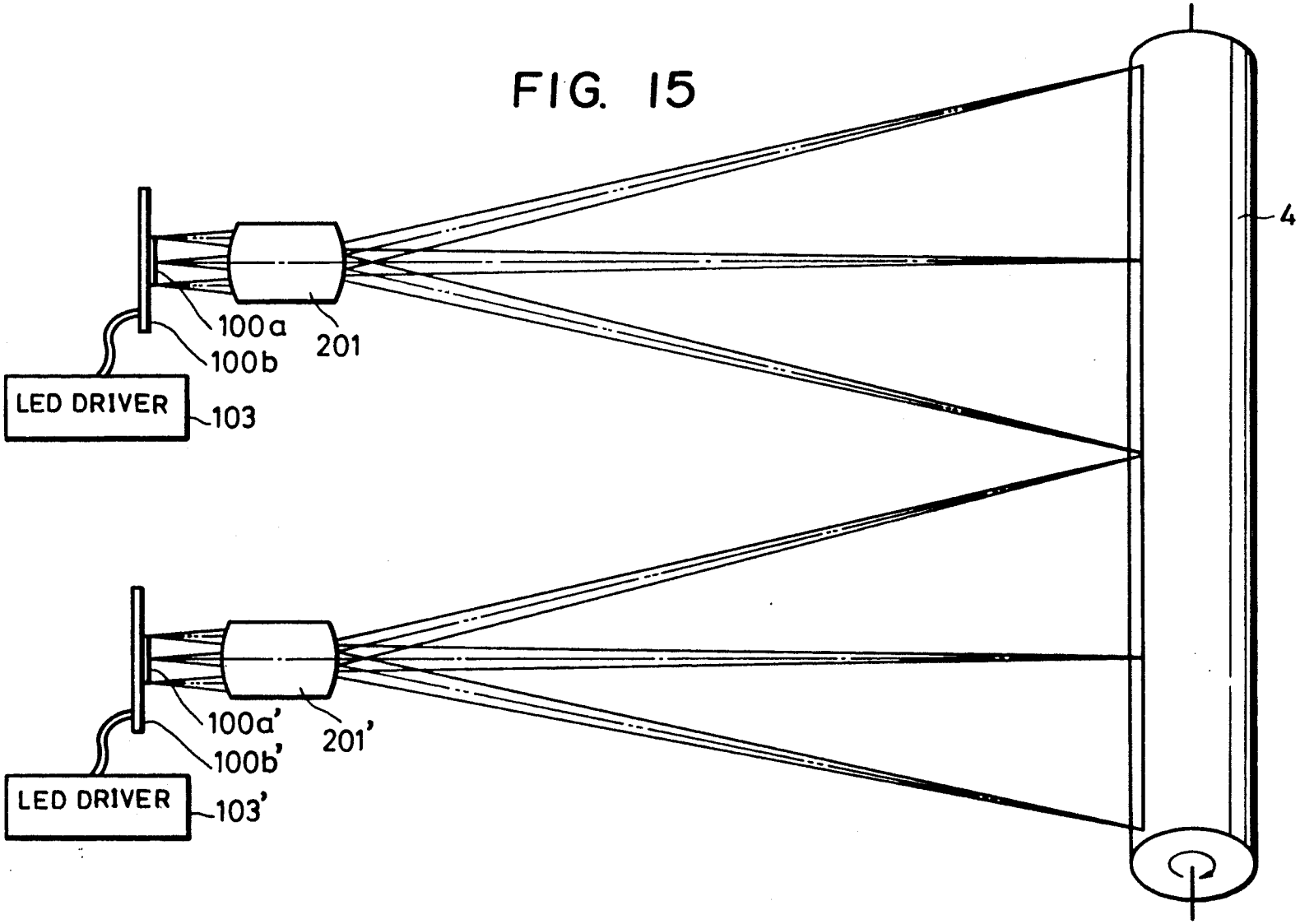
FIG. 15 shows an apparatus in which the optical system used in the image forming apparatus shown in FIG. 2 is used in plurality.

In addition, several optical systems according to the above-described embodiments may be disposed in a plurality of locations in the direction of the arrangement of the LED array, as shown in FIG. 15.

It is to be noted that the present invention is not limited to the above-described embodiments, but various modifications are possible within the true spirit and scope of the present invention.

What is claimed is:

1. An image forming apparatus comprising:

an image carrying member;

an LED (light emitting diode) array having a plurality of light-emitting units arranged in correspondence with the longer direction of said image carrying member, the width of said LED array being smaller than ann image carrying width of said image carrying member; and projection means for magnifying and projecting light from said LED array upon said image carrying member.

2. An image forming apparatus according to claim 1, wherein said LED array is formed by a photolithographic process.

3. An image forming apparatus according to claim 1, wherein said LED array comprises a monolithic LED array in which respective light emitting units are arranged on a single substrate.

4. An image forming apparatus according to claim 1, wherein the width of said LED array is subjected to magnified projection to the image carrying width on said image carrying member within which an image can be formed in the longer direction of said image carrying member by said projection means.

5. An image forming apparatus according to claim 1, wherein said projection means comprises a magnifying projection lens.

6. An image forming apparatus according to claim 1, wherein said LED array comprises a monolithic LED array formed by a photolithographic process and exposing non-image portions on said image carrying member.

7. An image forming apparatus according to claim 6, further comprising an LED driver for forming an emission pattern of said LED array, and wherein the emission of each LED of said LED array is controlled by said LED driver.

8. An image forming apparatus according to claim 1 wherein said projecting means comprises imaging means for imaging the light from said LED array upon said image carrying member, said imaging means including a first mode in which the light beams from respective light emitting units of said LED array are superposed on said image carrying member and a second mode in which the light beams from respective light emitting units of said LED array are not superposed.

9. An image forming apparatus according to claim 1, wherein said projection means includes a first mode for projecting the light from said LED array upon a first projection region on said image carrying member and a second mode for projecting the light upon a second projection region which is different from the first projection region.

10. An image forming apparatus according to claim 9, wherein said projection means comprises a soft-focus lens.

11. An image forming apparatus according to claim 9, wherein said projection means comprises a projection lens having aberration, and the amount of aberration on said image carrying member by said projection lens is larger than a value obtained by subtracting a width in the direction of arrangement from an arrangement pitch of projected images of said light emitting units.

12. An image forming apparatus according to claim 9, wherein said LED array, projection means and image carrying member constitute a telecentric optical system.

13. An image forming apparatus according to claim 9, wherein switching between the first mode and the second mode of said projection means is performed by moving said projection means in the longer direction of said image carrying member.

14. An image forming apparatus according to claim 13, wherein said LED array is moved together with the movement of said projection means.

15. An image forming apparatus according to claim 9, wherein at least regions of the longer direction and a moving direction of said image carrying member are different from each other in said first and second projection regions.

16. An image forming apparatus comprising:

an image carrying member;

an LED (light emitting diode) array having a plurality of light emitting units arranged in correspondence with the longer direction of said image carrying member; and soft-focus means for soft-focusing the light from said LED array upon said image carrying member.

17. An image forming apparatus according to claim 16, wherein the width of said LED array is smaller than an image carrying width on said image carrying member, and wherein the light from said LED array is subjected to magnified projection upon said image carrying member.

18. An image forming apparatus according to claim 16, wherein said soft-focus means comprises a soft-focus lens.

19. An image forming apparatus according to claim 16, wherein the light beams from respective LED's are superposed on said image carrying member.

20. An image forming apparatus according to claim 16, wherein said LED array is formed by a photolithographic process.

21. An image forming apparatus according to claim 20, further comprising an LED driver for forming an emission pattern of said LED array, and wherein the emission of each LED of said LED array is controlled by said LED driver.

22. An image forming apparatus comprising:

an image carrying member;

an LED (light emitting diode) array having a plurality of light emitting units arranged in the longer direction of said image carrying member; and projection means for projecting the light from said LED array upon said image carrying member, said projection means having an aberration whose amount on said image carrying member is larger than (P-D), where P is an arrangement pitch of the light emitting positions projected by said projection means, and D is a width of a pixel in the direction of arrangement.

23. An image forming apparatus according to claim 22, wherein the width of said LED array is smaller than an image carrying width on said image carrying member, and wherein the light from said LED array is subjected to magnified projection upon said image carrying member.

24. An image forming apparatus according to claim 22 wherein the shape of the light emitting units of said LED array is rectangular.

25. An image forming apparatus according to claim 22, wherein said projection means comprises a soft-focus lens.

26. An image forming apparatus according to claim 22, wherein the light beams from respective light emitting units of said LED array passing through said projection means are superposed on said image carrying member.

27. An image forming apparatus according to claim 22, wherein an amount of aberration on said image carrying member can be adjusted by changing the distance between said LED array and said projection means.

28. An image forming apparatus according to claim 22, wherein said projection means, LED array and image carrying member constitute a telecentric optical system which is telecentric to the side of said LED array with its entrance pupil, as seen from the side of said LED array, existing at an infinite distance.

29. An image forming apparatus according to claim 28, wherein the distribution of the amount of light projected from said LED array upon said image carrying member is nearly uniform in the longer direction of said image carrying member.

30. An image forming apparatus according to claim 22, wherein said amount of aberration is the maximum amount of aberration at the center of an image carrying width on said image carrying member in the longer direction of said image carrying member.

31. An image forming apparatus according to claim 22, wherein said LED array is formed by a photolithographic process.

32. An image forming apparatus comprising:

an image carrying member;

an LED (light emitting diode) array having a plurality of light emitting units arranged in the longer direction of said image carrying member; and lens means for projecting light from said LED array upon said image carrying member, said lens means comprises a telecentric optical system at a side of said LED array, the principal ray of the light incident upon said lens means from said each light emitting unit of the LED array being parallel to an optical axis of said lens means.

33. An image forming apparatus according to claim 32, wherein said LED array, lens means and image carrying member constitute a telecentric optical system with its entrance pupil, as seen from the side of said LED array existing at an infinite distance.

34. An image forming apparatus according to claim 32, wherein the distribution of the amount of light projected from said LED array upon said image carrying member is nearly uniform in the longer direction of said image carrying member.

35. An image forming apparatus according to claim 32, wherein the width of said LED array is smaller than an image carrying width on said image carrying member in the longer direction of said image carrying member, and wherein the light from said LED array is subjected to magnified projection upon said image carrying member.

36. An image forming apparatus according to claim 32, wherein said lens means comprises soft-focus means.

37. An image forming apparatus according to claim 32, wherein said lens means has an aberration whose amount on said image carrying member is larger than a value obtained by subtracting a width in the direction of arrangement from an arrangement pitch of projected images of said light emitting units.

38. An image forming apparatus according to claim 1, 16, 22 or 32, wherein said image forming apparatus is applied to a copier.

39. An image forming apparatus comprising:

an image carrying member;

an LED (light emitting diode) array having a plurality of light emitting units arranged in correspondence with the longer direction of said image carrying member; and imaging means for imaging the light from said LED array upon said image carrying member;

said imaging means including a first mode in which the light beams from respective light emitting units of said LED array are superposed on said image carrying member and a second mode in which the light beams from respective light emitting units of said LED array are not superposed, and wherein said LED array, imaging means and image carrying member constitute a telecentric optical system.

40. An image forming apparatus comprising:

an image carrying member;

an LED (light emitting diode) array having a plurality of light emitting units arranged in correspondence with the longer direction of said image carrying member; and imaging means for imaging the light from said LED array upon said image carrying member;

said imaging means including a first mode in which the light beams from respective light emitting units of said LED array are superposed on said image carrying member and a second mode in which the light beams from respective light emitting units of said LED array are not superposed, and wherein switching between the first mode and the second mode of said imaging means is performed by inserting and taking out an optical member.

41. An image forming apparatus according to claim 40, wherein said optical member comprises a lens having aberration.

42. An image forming apparatus comprising:

an image carrying member;

an LED (light emitting diode) array having a plurality of light emitting units arranged in correspondence with the longer direction of said image carrying member; and imaging means for imaging for light from said LED array upon said image carrying member;

said imaging means including a first mode in which the light beams from respective light emitting units of said LED array are superposed on said image carrying member and a second mode in which the light beams from respective light emitting units of said LED array are not superposed, and wherein an amount of aberration on said image carrying member by said imaging means is smaller in the second mode than in the first mode.

43. An image forming apparatus according to claim 42, wherein the amount of aberration on said image carrying member in the first mode by said imaging means is larger than a value obtained by subtracting a width of a pixel in the direction of arrangement from an arrangement pitch of projected images of said light emitting units.

44. An image forming apparatus according to claim 42, wherein the amount of aberration on said image carrying member in the second mode by said imaging means is smaller than a value obtained by subtracting a width of a pixel in the direction of arrangement from an arrangement pitch of projected images of said light emitting units.

45. An image forming apparatus comprising:

an image carrying member:

an LED (light emitting diode) array having a plurality of light emitting units arranged in correspondence with the longer direction of said image carrying member; and a projection means for projecting the light from said LED array upon said image carrying member, said projection means including a first mode for projecting the light from said LED array upon a first projection region on said image carrying member and a second mode for projecting the light upon a second projection region which is different from the first projection region, wherein switching between the first mode and the second mode of said projection means is performed by inserting and taking out an attachment lens as an additional lens.

46. An image forming apparatus comprising:

an image carrying member:

an LED (light emitting diode) array having a plurality of light emitting units arranged in correspondence with the longer direction of said image carrying member; and a projection means for projecting the light from said LED array upon said image carrying member, said projection means including a first mode for projecting the light from said LED array upon a first projection region on said image carrying member and a second mode for projecting the light upon a second projection region which is different from the first projection region, wherein said projection means comprises a zoom lens.

* * * * *

UNITED STATES PATENT AND TRADEMARK OFFICE

CERTIFICATE OF CORRECTION

PATENT NO. : 5,160,965

DATED : November 3, 1992

INVENTOR(S) : Jun Koide

It is certified that error appears in the above-identified patent and that said Letters Patent is hereby corrected as shown below:

COVER PAGE

Under [75] Inventor, "Jun Koide, Tokyo, Japan" should read --Jun Koide, Yokohama, Japan--; and Under [56] References Cited, Foreign Patent Documents, "01031659 2/1989 Japan" should read -- 1-031659 2/1989 Japan--.

COLUMN 2

Line 13, "applied" should read --applied;--; and
Line 25, "softfocus" should read --soft-focus--.

COLUMN 3

Line 31, "an" should read --a--.

COLUMN 5

Line 48, "is" should read --does--; and
Line 53, "have" should read --has--.

COLUMN 6

Line 55, "ann" should read --an--.

UNITED STATES PATENT AND TRADEMARK OFFICE

CERTIFICATE OF CORRECTION

PATENT NO. : 5,160,965

DATED : November 3, 1992

INVENTOR(S) : Jun Koide

It is certified that error appears in the above-identified patent and that said Letters Patent is hereby corrected as shown below:

COLUMN 8

Line 41, "22" should read --22,--.

COLUMN 10

Line 23, "for light" should read --the light--.

Signed and Sealed this

Ninth Day of November, 1993

Bruce Lehman

*Attest:*

BRUCE LEHMAN

*Attesting Officer*

*Commissioner of Patents and Trademarks*